US007634986B2

(12) United States Patent
Kuroda et al.

(10) Patent No.: US 7,634,986 B2
(45) Date of Patent: Dec. 22, 2009

(54) FUEL SUPPLY SYSTEM HAVING FUEL FILTER INSTALLED DOWNSTREAM OF FEED PUMP

(75) Inventors: Akihiro Kuroda, Kariya (JP); Hiroyuki Shimai, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/327,196

(22) Filed: Dec. 3, 2008

(65) Prior Publication Data

US 2009/0145403 A1 Jun. 11, 2009

(30) Foreign Application Priority Data

Dec. 5, 2007 (JP) ..... 2007-314632

(51) Int. Cl.
*F02M 69/54* (2006.01)

(52) U.S. Cl. ..... 123/457; 123/446; 123/447; 123/506; 123/511; 123/510

(58) Field of Classification Search ..... 123/446, 123/447, 457, 506, 510, 511
See application file for complete search history.

(56) References Cited

U.S. PATENT DOCUMENTS 5,918,578 A * 7/1999 Oda ..... 123/456
6,058,912 A * 5/2000 Rembold et al. ..... 123/516
6,234,148 B1 * 5/2001 Hartke et al. ..... 123/447
6,609,500 B2 * 8/2003 Ricco et al. ..... 123/446
7,343,901 B2 * 3/2008 Mori et al. ..... 123/446
2008/0156295 A1 7/2008 Suzuki et al.

FOREIGN PATENT DOCUMENTS

JP 2008-180208 8/2008

* cited by examiner

*Primary Examiner*—Stephen K Cronin
*Assistant Examiner*—J. Page Hufty
(74) *Attorney, Agent, or Firm*—Nixon & Vanderhye, PC

(57) ABSTRACT

A fuel supply system for delivering fuel to, for example, a common rail of a diesel engine fuel injection system. The fuel supply system includes a priming pump, a feed pump, a fuel filter disposed downstream of the feed pump, a return path, and a return valve. When the pressure of the fuel between the feed pump and the fuel filter exceeds a first set pressure, the return valve is placed in a first open position to open the return path to return the fuel from downstream to upstream of the feed pump. When the pressure of the fuel, as fed by the priming pump, exceeds a second set pressure, the return valve is placed in a second open position to open the return path to direct the fuel, as fed by the priming pump, to upstream of the fuel filter to prime the fuel filter directly.

9 Claims, 6 Drawing Sheets

FUEL SUPPLY SYSTEM HAVING FUEL FILTER INSTALLED DOWNSTREAM OF FEED PUMP

CROSS REFERENCE TO RELATED DOCUMENT

The present application claims the benefit of Japanese Patent Application No. 2007-314632 filed on Dec. 5, 2007, the disclosures of which are incorporated herein by reference.

BACKGROUND OF THE INVENTION

1. Technical Field of the Invention

The present invention relates generally to a fuel supply system which may be employed in automotive common rail fuel injection systems, and more particularly to such a fuel supply system which is equipped with a fuel filter installed downstream of a feed pump and designed to have a simple structure which ensures the mountability thereof in vehicles and may be produced at a low cost.

2. Background Art

Typical fuel supply systems for use in accumulator fuel injection systems for diesel engines are equipped with a high-pressure pump, a feed pump, and a fuel filter. The high-pressure pump works to pressurize and deliver fuel to a common rail in which the fuel is accumulated at a controlled high pressure. The feed pump works to pump the fuel out of a fuel tank and feed it to the high-pressure pump. The fuel filter is disposed downstream of the feed pump to develop a great difference in pressure across the fuel filter, thereby allowing the a filter medium of the fuel filter to be reduced in mesh size in order to capture smaller foreign objects.

Usually, when the fuel supply system is installed in the vehicle and connected to the engine, or the fuel filter is replaced, a fuel pipe between the fuel tank and the feed pump and the fuel filter need to be filled with the fuel in order to ensure the stability in starting the engine. The fuel supply system in which the fuel filter is located downstream of the feed pump, however, encounters the drawback in that the feed pump will be a hydraulic resistance against the flow of fuel, which results in a difficulty in supplying the fuel to the fuel filter using a priming pump. The fuel filter may be primed directly, which, however, results in a complicated structure, an increase in production cost, and a decrease in mountability of the fuel supply system in the vehicles.

SUMMARY OF THE INVENTION

It is therefore an object of the invention to provide a simple structure of a fuel supply system for vehicles which is equipped with a fuel filter disposed downstream of a feed pump working to pump fuel out of a fuel tank and designed to ensure the mountability thereof in vehicles and may be produced at a low cost.

According to one aspect of the invention, there is provided a fuel supply system for an accumulator fuel injection system such as a common rail fuel injection system for automotive diesel engines. The fuel supply system is designed to inject fuel, as stored in an accumulator, into an internal combustion engine through a fuel injector and comprises: (a) a feed pump working to pump fuel out of a fuel tank through a first fuel path and feed the fuel to a second fuel path; (b) a high-pressure pump working to pressurize and supply the fuel, as fed from the feed pump through the second fuel path, to an accumulator; (c) a priming pump disposed between the fuel tank and the feed pump, the priming pump working to pump the fuel out of the fuel tank to feed the fuel through the first fuel path; (d) a fuel filter disposed in the second fuel path between the feed pump and the high-pressure pump to filter the fuel, as delivered from the feed pump to the high-pressure pump; (e) a return path extending from between the feed pump and the fuel filter in the second fuel path to between the priming pump and the feed pump in the first fuel path; and (f) a return valve working to open and close the return path selectively. When a fuel feeding pressure that is a pressure of the fuel in the second fuel path between the feed pump and the fuel filter exceeds a first set pressure, the return valve is placed in a first open position to open the return path to return the fuel from downstream to upstream of the feed pump. When a fuel priming pressure that is a pressure of the fuel, as fed by the priming pump, exceeds a second set pressure, the return valve is placed in a second open position to open the return path to direct the fuel, as fed by the priming pump, to downstream of the feed pump.

Specifically, when it is required to prime the fuel filter, the return valve opens the return path to direct the fuel to the fuel filter without passing it through the feed pump. This eliminates the need for additional parts such as a bypass and a check valve for priming the fuel filter and ensures the mountability of the fuel supply system in vehicles without having to complexity the structure thereof.

In the preferred mode of the invention, the return valve may be designed to include a first valve element and a second valve element. The first valve element has a length with a first and a second end. The first end is to be subjected to the fuel feeding pressure. When the fuel feeding pressure reaches the first set pressure, the first valve element is moved in a lengthwise direction thereof to the first open position to open the return path. The first valve element has formed therein a communicating path communicating at ends thereof with the return path. When the fuel priming pressure exceeds the second set pressure, the second valve element opens the communicating path.

The return valve may include a first spring urging the first valve element into a closed position to close the return path and a second spring urging the second valve element into a closed position to close the communicating path.

The second spring is held elastically by the first and second valve elements. Specifically, the elastic pressure, as produced by the second spring, does not affect the operation of the first valve element, thereby stabilizing the pressure at which the first valve element is to be moved to open the return path.

The second valve element and the second spring are disposed in the communicating path. The first valve element has a valve seat formed on an inner surface exposed to the communicating path. The second valve element is urged by the second spring into contacting abutment with the valve seat to close the communicating path. Specifically, the second valve element and the second spring are installed inside the first valve element, thus permitting the return valve to be reduced in size.

The valve seat of the first valve element may be of a conical shape, while the second valve element may be made of a ball. This ensures the hermetical sealing of the communicating path.

The return valve may alternatively include a valve element having a length with a first and a second end. The first end is to be subjected to the fuel feeding pressure. When the fuel feeding pressure reaches the first set pressure, the valve element is moved in a first direction oriented from the first to the second ends to the first open position to open the return path. The second end is to be subjected to the fuel priming pressure. When the fuel priming pressure exceeds the second set pressure, the valve element is moved in a second direction opposite the first direction to the second open position to open the return path.

The valve element may have formed therein a communicating path with a first end communicating with the return path at all times and a second end establishing fluid communication with the return path selectively. When the valve element is moved to the second open position, it establishes the fluid communication of the second end with the return path.

The return valve may be equipped with a valve element and a hollow cylindrical sleeve. The sleeve has a sleeve hole formed in a middle portion in a lengthwise direction of the sleeve. The sleeve hole communicates with a portion of the first fuel path between the priming pump and the feed pump through the return path. The valve element is disposed slidably within the sleeve to define a first chamber and a second chamber within the sleeve. The first chamber connects with a portion of the second fuel path between the feed pump and the fuel filter through the return path. The second chamber connects with a portion of the first fuel path between the priming pump and the feed pump through the return path. When the fuel feeding pressure is below the first set pressure, the valve element is placed in a closed position to close the sleeve hole to block fluid communication between the sleeve hole and the first chamber. When the fuel feeding pressure is higher than or equal to the first set pressure, the valve member is moved to the first open position which opens the sleeve hole to establish fluid communication between the sleeve hole and the first chamber to return the fuel from downstream to upstream of the feed pump.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
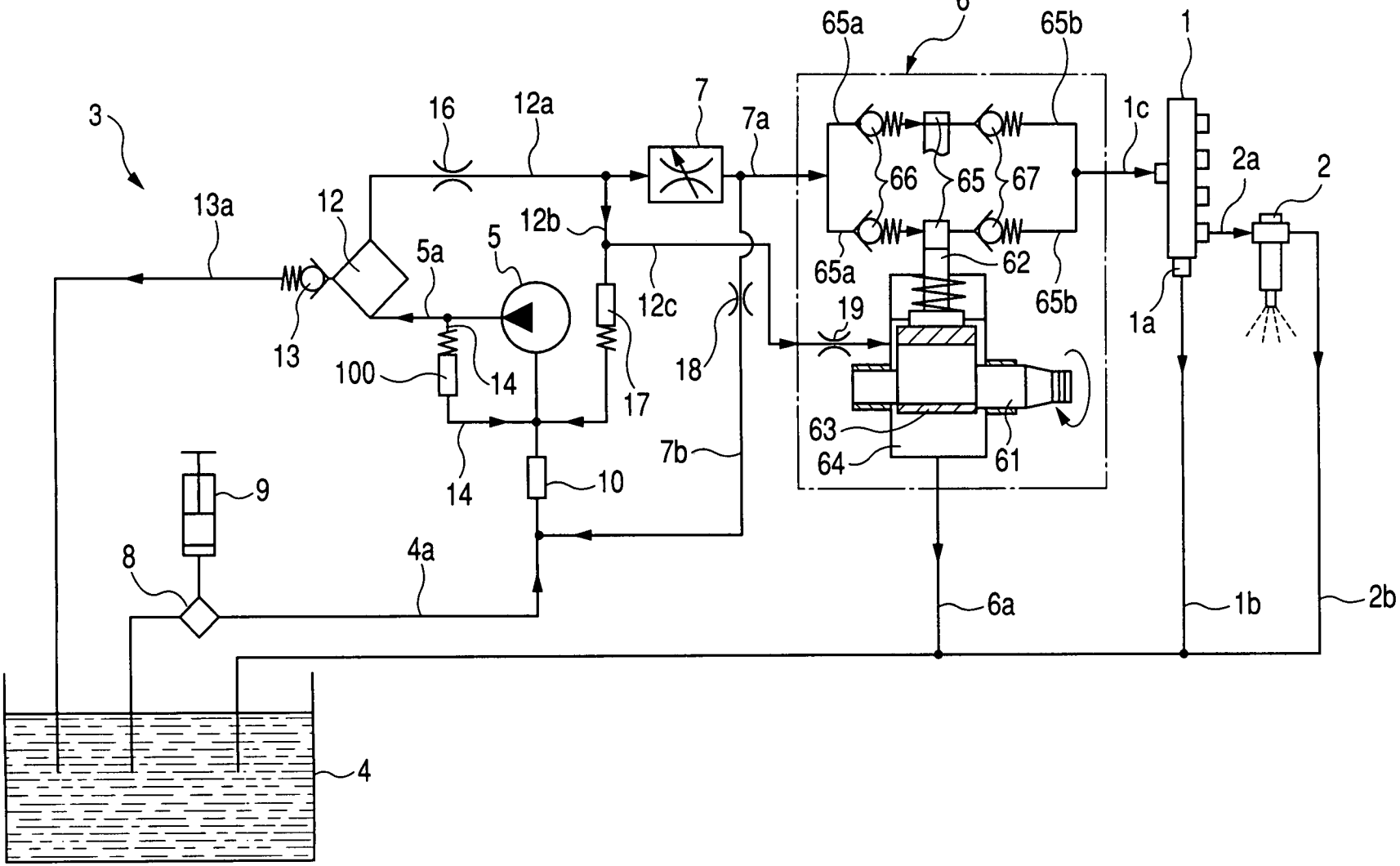
FIG. 1 is a block diagram which shows an accumulator fuel injection system equipped with a fuel supply system according to the first embodiment of the invention.

Referring to the drawings, wherein like reference numbers refer to like parts in several views, particularly to FIG. 1, there is shown an accumulator fuel injection system such as a common rail fuel injection system for automotive diesel engines equipped with a fuel supply system 3 according to the first embodiment of the invention.

The accumulator fuel injection system is used with a four-cylinder diesel engine (not shown) and equipped with a common rail 1, fuel injectors 2 (only one is illustrated), and the fuel supply system 3. The fuel injectors 2 are installed one for each cylinder of the diesel engine and work to spray the fuel, as supplied from the common rail 1, into the engine. The fuel supply system 3 supplies the fuel to the common rail 1.

The common rail 1 works as an accumulator to store the fuel, as delivered from the fuel supply system 3, at a controlled target pressure which is determined by an electronic control unit (ECU) not shown as a function of an operating condition of the diesel engine which is represented, for example, by an open position of an accelerator pedal and the speed of the diesel engine.

The common rail 1 has installed therein a pressure limiter 1*a* which is to be opened to release the fuel from the common rail 1 when the pressure of fuel in the common rail 1 exceeds an upper limit. The released fuel is returned back to a fuel tank 4 of the fuel supply system 3 through a fuel pipe 1*b*.

The fuel injector 2 is supplied with the fuel from the common rail 1 through a high-pressure pipe 2*a*. An excess of the fuel not having been sprayed from the fuel injector 2 is returned back to the fuel tank 4 through a fuel pipe 2*b*. The fuel injector 2 is connected electrically to the ECU. The ECU controls the injection timing and quantity of the fuel to be injected by the fuel injector 2 into the diesel engine.

The fuel supply system 3 includes the fuel tank 4, a feed pump 5, a high-pressure pump 6, and a suction control valve 7. The feed pump 5 sucks the fuel from the fuel tank 4 and delivers it to the high-pressure pump 6. The high-pressure pump 6 pressurizes the fuel, as delivered from the feed pump 5, and supplies it to the common rail 1. The suction control valve 7 function as a flow rate control valve to control the flow rate of fuel supplied from the feed pump 5 to the high-pressure pump 6.

The feed pump 5 connects with the fuel tank 4 through an inlet pipe 4*a* to pump the fuel out of the fuel tank 4 and deliver it to the high-pressure pump 6. The feed pump 5 of this embodiment is implemented by a trochoid pump that is an internal gear pump. The feed pump 5 is joined to a camshaft 61 of the high-pressure pump 6 so that it is driven by torque transmitted from the camshaft 61.

A pre-filter 8 and a priming pump 9 are installed in the inlet pipe 4*a*. The pre-filter 8 works to filter foreign objects from the fuel pumped out of the fuel tank 4. The priming pump 9 is of a manually-operated type and works to draw air from the inlet pipe 4*a* during assembling of the vehicle. A gauze filter 10 is installed in the inlet pipe 4*a* closer to an inlet of the feed pump 5 to filter foreign objects from the fuel flowing downstream of the pre-filter 8. The pre-filter 8 and the gauze filter 10 may be made of a metallic mesh.

A fuel filter 12 is connected downstream of the feed pump 5 through a fuel path 5*a*. The fuel filter 12 works to filter the fuel, as delivered from the feed pump 5. The fuel filter 12 is equipped with a relief valve 13 which is opened to release the fuel from the fuel filter 12 when the pressure of fuel passing through the fuel filter 12 exceeds a preset level. Specifically, when opened, the relief valve 13 drains the part of the fuel, as outputted from the feed pump 5, to the fuel tank 4 through a fuel drain pipe 13*a*.

The relieve valve 13 is designed to be opened when the pressure of fuel acting on the fuel filter 12 exceeds the level which is higher than or equal to the pressure of fuel discharged from the feed pump 5 when the diesel engine is idling and lower than or equal to a withstanding upper limit pressure of the fuel filter 12. The relief valve 13 serves to avoid the exertion of an excessive pressure of the fuel discharged from the feed pump 5 on the fuel filter 12.

The fuel filter 12 is subjected to the pressure of fuel discharged from the feed pump 5 and, thus, may be made of a filter medium which is smaller in mesh size, that is, higher in filtration than the pre-filter 8 and the gauze filter 10 in order to capture small foreign objects or water which the pre-filter 8 and the gauze filter 10 can't remove from the fuel.

A return path 14 is disposed which extends from between the feed pump 5 and the fuel filter 12 to between the feed pump 5 and the priming pump 9. The return path 14 has installed therein a return valve 100 which works to open or close the return path 14 selectively to control the flow rate of fuel to be returned to upstream of the feed pump 5. When the priming pump 9 is actuated, the return valve 100 also works to open the return path 14 to permit the fuel to be primed into the fuel filter.

The suction control valve 7 is connected to downstream of the fuel filter 12 through a fuel path 12*a*. An orifice 16 is installed in the fuel path 12*a*. The suction control valve 7 is implemented by a linear solenoid-operated valve whose open position is regulated continuously or linearly in response to a control signal outputted from the ECU as a function of the operating condition of the diesel engine.

The orifice 16 is provided by a smaller-diameter portion of the fuel path 12*a* and serves as a flow rate control device which works to control or decrease the flow rate of the fuel passing through the fuel filter. A portion of the fuel path 12*a* located downstream of the orifice 16 and upstream of the suction control valve 7 is joined to between downstream of the gauze filter 10 and upstream of the feed pump 5 through a fuel path 12*b*. A regulator valve 17 is installed in the fuel path 12*b*.

The regulator valve 17 is made up of a valve element and a spring urging the valve element into a closed position and works to control an area of the fuel path 12*b* mechanically to keep the pressure of fuel flowing downstream of the orifice 16 below a given level. A fuel path 12*c* is joined to the fuel path 12*b* to direct the fuel from upstream of the regulator valve 17 to a cam chamber 64 of the high-pressure pump 6 which will be described later in detail.

The high-pressure pump 6 is joined downstream of the suction control valve 7 through a fuel path 7*a*. A fuel path 7*b* is connected to the fuel path 7*a* through an orifice 18 to return the fuel to upstream of the gauze filter 10. For instance, when the suction control valve 7 is in a closed position, an excess of fuel flowing downstream of the suction control valve 7 is returned to upstream of the feed pump 5 through the fuel path 7*b*.

The high-pressure pump 6, as indicated by a broken line in FIG. 1, includes the camshaft 61 driven by the output torque of the diesel engine and two plungers 62 (only one is shown for the brevity of illustration) reciprocating following rotation of the camshaft 61 within cylinders. The plungers 62 are opposed in alignment with each other in a radius direction of the camshaft 61 so that they move in a suction or a compression (i.e., a discharge) stroke alternately.

The camshaft 61 has a cam 63 fit thereon which works to convert the rotation of the camshaft 61 into linear motion of the plungers 62. The cam 63 is disposed in the cam chamber 64 formed in a pump housing of the high-pressure pump 6. The fuel flowing into the cam chamber 64 through the fuel path 12*b* is used as lubricant for the cam 63 and the plungers 62.

An orifice 19 is disposed in the fuel path 12*c* to keep the flow rate of the fuel supplied to the cam chamber 64 at a selected value. An excess of the fuel overflowing out of cam chamber 64 is returned back to the fuel tank 4 through a fuel path 6*a*.

Pressure chambers 65 are defined in the cylinders within which the plungers 62 are disposed. The volume of each of the pressure chambers 65 is changed by the reciprocating motion of a corresponding one of the plungers 62. An inlet path 65*a* and an outlet path 65*b* are connected to each of the pressure chambers 65. The inlet path 65*a* connects with the fuel path 7*a* to supply the fuel to the pressure chamber 65. The outlet path 65*b* connects with a fuel path 1*c* and outputs the fuel from the pressure chamber 65 to the common rail 1.

Inlet valves 66 are disposed one in each of the inlet paths 65*a*. The inlet valves 66 are opened when the fuel is sucked into the pressure chambers 65. Outlet valves 67 are disposed one in each of the outlet paths 65*b*. The outlet valves 67 are opened when the fuel is discharged to the common rail 1 through the fuel path 1*c*.

Figure 2:
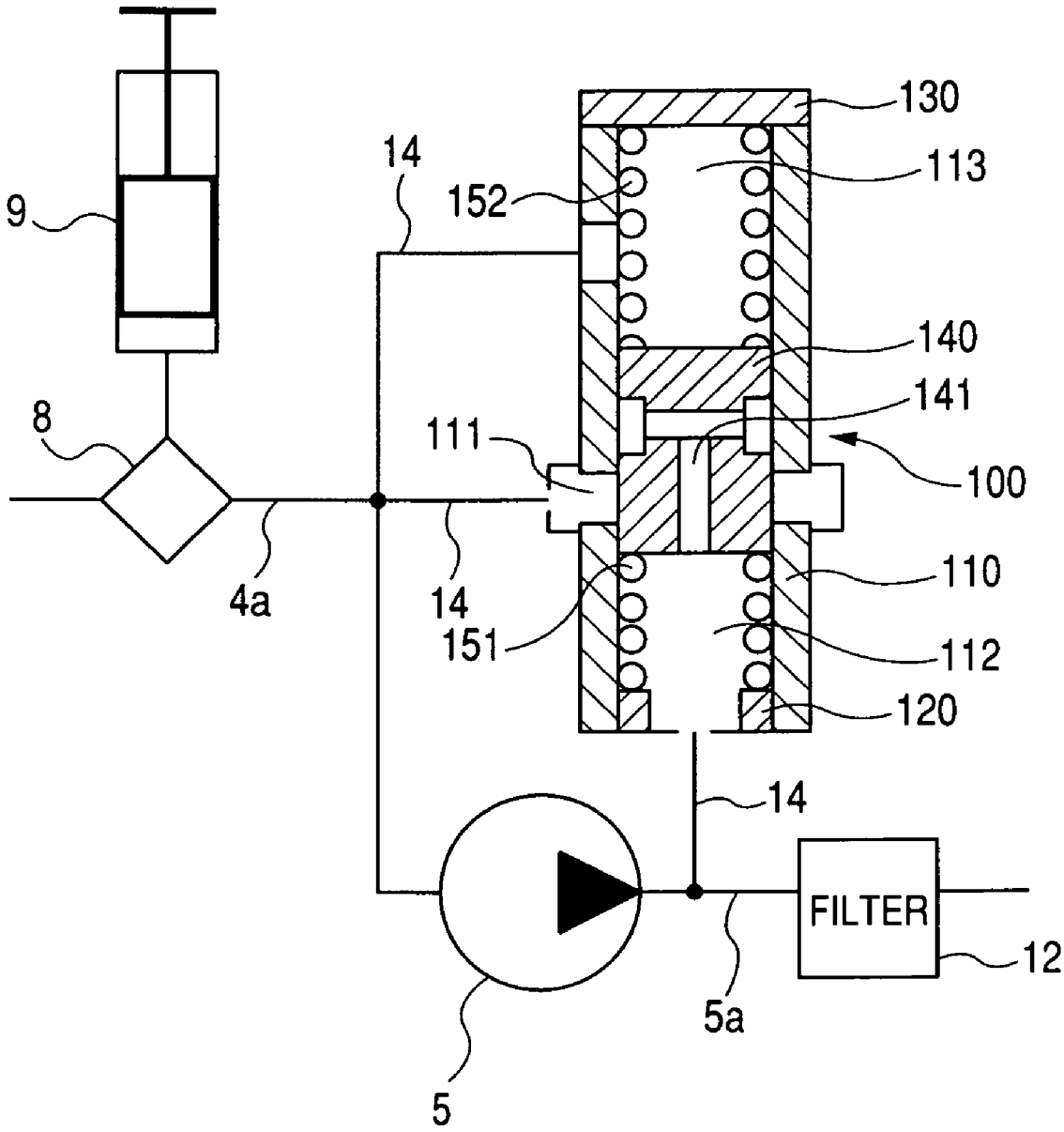
FIG. 2 is a longitudinal sectional view which illustrates an internal structure of a return valve which is installed in the fuel supply system of FIG. 1 and placed in a closed position.
Figure 3:
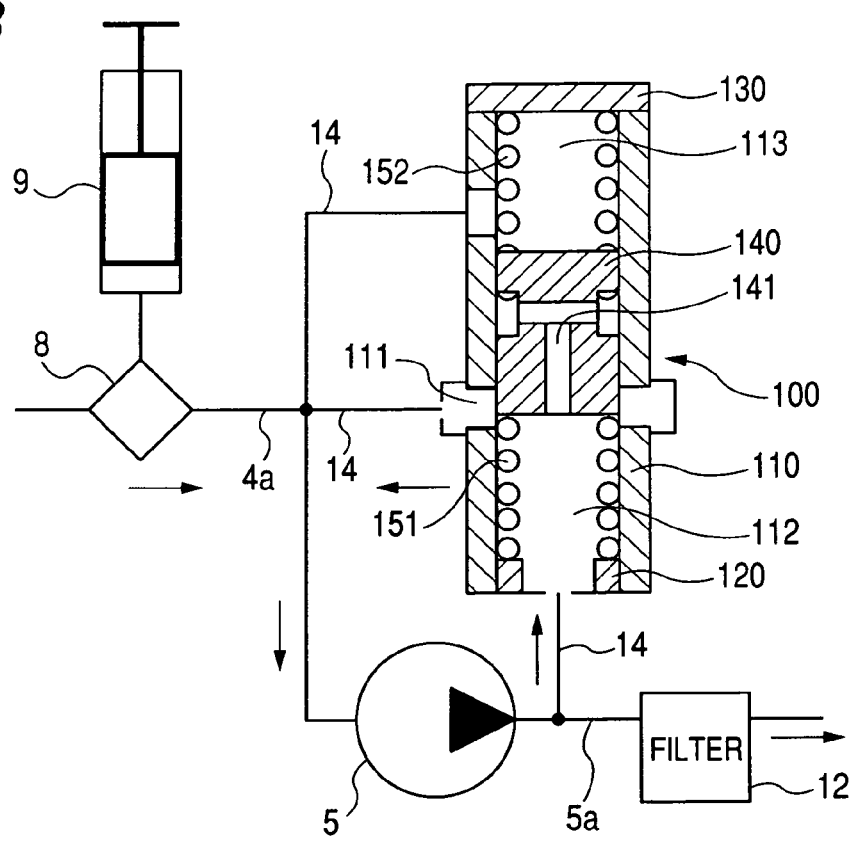
FIG. 3 is a longitudinal sectional view which illustrates an internal structure of the return valve of FIG. 2 which is placed in a first open position to return fuel from downstream to upstream of a feed pump.
Figure 4:
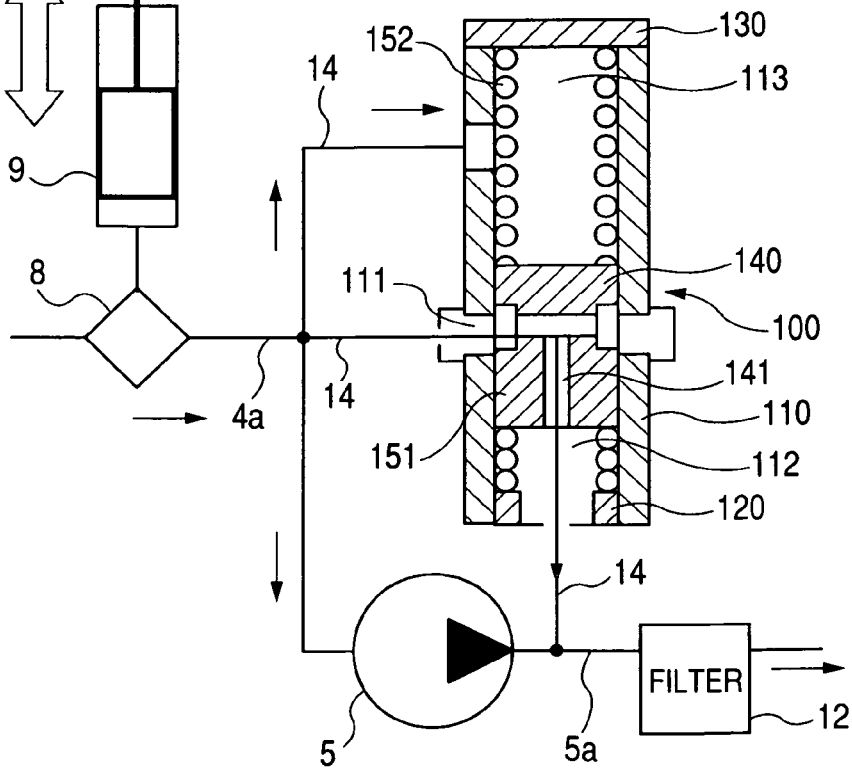
FIG. 4 is a longitudinal sectional view which illustrates an internal structure of the return valve of FIG. 2 which is placed in a second open position to prime a fuel filter.

FIG. 2 is a partially sectional view which illustrates an internal structure of the return valve 100 placed in a closed position. FIG. 3 is a partially sectional view which illustrates an internal structure of the return valve 100 placed in an open position when the feed pump 5 is actuated. FIG. 4 is a partially sectional view which Illustrates an internal structure of the return valve 100 placed in an open position when the priming pump 9 is actuated.

The return valve 100 is, as clearly illustrated in FIGS. 2 to 4, equipped with a hollow cylindrical sleeve 110. The sleeve 110 has through holes 111 formed in a middle portion in a lengthwise direction thereof. The holes 111 (will also be referred to as sleeve holes below) are diametrically opposed to each other and communicate with a portion of the inlet pipe 4*a* between the pre-filter 8 and the feed pump 5 through the return path 14. FIGS. 2 to 4 show only a fluid communication between the return path 14 and a left one of the sleeve holes 111 for the brevity of illustration. A hollow cylindrical stopper 120 is fit in an open end of the sleeve 110. A disc-shaped plug 130 is fit in the other open end of the sleeve 110 to close it.

A first valve element 140 made of a cylindrical needle is disposed slidably within the sleeve 110 define a first chamber 112 and a second chamber 113. The first chamber 112 closer to the stopper 120 communicates with a fuel path 5*a* extending between the feed pump 5 and the fuel filter 12 through the return path 14. The second chamber 113 closer to the plug 130 communicates with a portion of the inlet pipe 4*a* between the pre-filter 8 and the feed pump 5.

The first valve element 140 has formed therein a T-shaped communicating path 141 which has three open ends. Specifically, opposed two of the ends of the communicating path 141 open at the outer periphery of the first valve element 140 and are to communicate with the return path 14 through the sleeve holes 111 when the first valve element 140 is moved downward, as viewed in FIG. 2. In other words, the communicating path 141 defines a middle portion of the return path 14 when the first valve eminent 140 is placed in an open position, A spring 151 is disposed in the first chamber 112 of the sleeve 110 to urge the first valve element 140 toward the plug 130. Similarly, a spring 152 is disposed in the second chamber 113 to urge the first valve element 140 toward the stopper 120.

In operation of the accumulator fuel injection system, when the diesel engine starts to run, it will cause the camshaft 61 of the high-pressure pump 6 to rotate, thereby transmitting the torque from the camshaft 61 to the feed pump 5. The feed pump 5 then pumps the fuel out of the fuel tank 4 through the inlet pipe 4*a*. The pumped fuel passes through the pre-filter 8 and the gauze filter 10 and enters the feed pump 5. The fuel, as discharged from the feed pump 5, flows through the fuel filter 12 and enters the suction control valve 7 through the fuel paths 5*a* and 12*a*.

The suction control valve 7 is controlled in the open position thereof by the control signal outputted from the ECU to deliver the fuel to the high-pressure pump 6 through the fuel path 7*a* at a flow rate needed to meet a required operating condition of the diesel engine.

The rotation of the cam 63 will cause the plungers 62 of the high-pressure pump 61 to reciprocate. When each of the plungers 62 is moved to the camshaft 61 within the cylinder, it will cause the volume of the pressure chamber 65 to increase, so that the pressure in the pressure chamber 65 drops. This causes the inlet valves 66 to be opened, so that the fuel, as discharged from the suction control valve 7, flows into the pressure chambers 65 through the fuel path 7*a* and the inlet paths 65*a*.

When each of the plungers 61 is moved away from the camshaft 61, it will cause the volume of the pressure chamber 65 to decrease, so that the pressure in the pressure chamber 65 rises. When the pressure in the pressure chamber 65 exceeds a level opening the outlet valves 67, the fuel is discharged from the pressure chambers 65 to the common rail 1 through the fuel paths 65*b* and 1*c*.

The fuel is stored in the common rail 1 in the manner, as described above, and sprayed into the diesel engine through the fuel injectors 2 when opened by the ECU.

During the operation of the feed pump 5, the pressure of fuel between the feed pump 5 and the fuel filter 12, that is, the pressure of fuel, as elevated by the feed pump 5, (which will be referred to as a fuel feeding pressure below) is exerted on the end of the first valve element 140 exposed to the first chamber 112 to urge the first valve element 140 toward the second chamber 113. Specifically, a rise in the fuel feeding pressure will cause the first valve element 140 to be moved toward the second chamber 113 against the pressure, as produced by the spring 152.

When the fuel feeding pressure is below a first set pressure, the first valve element 140 is, as illustrated in FIG. 2, placed in the closed position to close the sleeve holes 111, so that the fluid communication between the sleeve holes 111 and the first chamber 112 is blocked to close the return path 14. When the fuel feeding pressure reaches the first set pressure, it will cause the first valve element 140 to be moved to a first open position, as illustrated in FIG. 3, which establishes fluid communication between the first chamber 112 and the sleeve holes 111 to open the return path 14, thereby causing the part of the fuel lying downstream of the feed pump 5 to be returned back to upstream of the feed pump 5. This results in a decrease in loss of pressure of the fuel sucked by the feed pump 5, which avoids the generation of vapor in the inlet pipe 4*a*.

The first set pressure is approximate to the pressure of fuel at which the relief valve 13 is to be opened and selected to be lower than such a pressure. The return valve 100 is, therefore, opened prior to opening of the relief valve 13 to return the fuel from downstream to upstream of the feed pump 5. When the return valve 100 is placed in the open position, but the pressure of fuel downstream of the feed pump 5 rises, the relief valve 13 will be opened.

When the priming pump 9 is actuated after the fuel supply system 3 is installed in the vehicle in connection with the diesel engine, the pressure of fuel (which will also be referred to as a fuel priming pressure below), as elevated by the priming pump 9, is exerted on the end of the first valve element 140 exposed to the second chamber 113 to urge the first valve element 140 toward the first chamber 112 against the pressure, as produced by the spring 151.

When the fuel priming pressure reaches a second set pressure, it will cause the first valve element 140 to be moved to a second open position, as illustrated in FIG. 4, which establishes fluid communication between the sleeve holes 111 and the first chamber 112 to open the return path 14 through the communicating path 141, thereby causing the fuel, as delivered by the priming pump 9, to flow from the inlet pipe 4*a*, to the return path 14, to the sleeve holes 111, to the communicating path 114, to the first chamber 112, to the return path 14, to the fuel path 5*a*, and to the fuel filter 12. In other words, the fuel, as fed from the priming pump 5, bypasses the feed pump 5 and reaches the fuel filter 12. This facilitates ease of priming the fuel filter 12.

Figure 5:
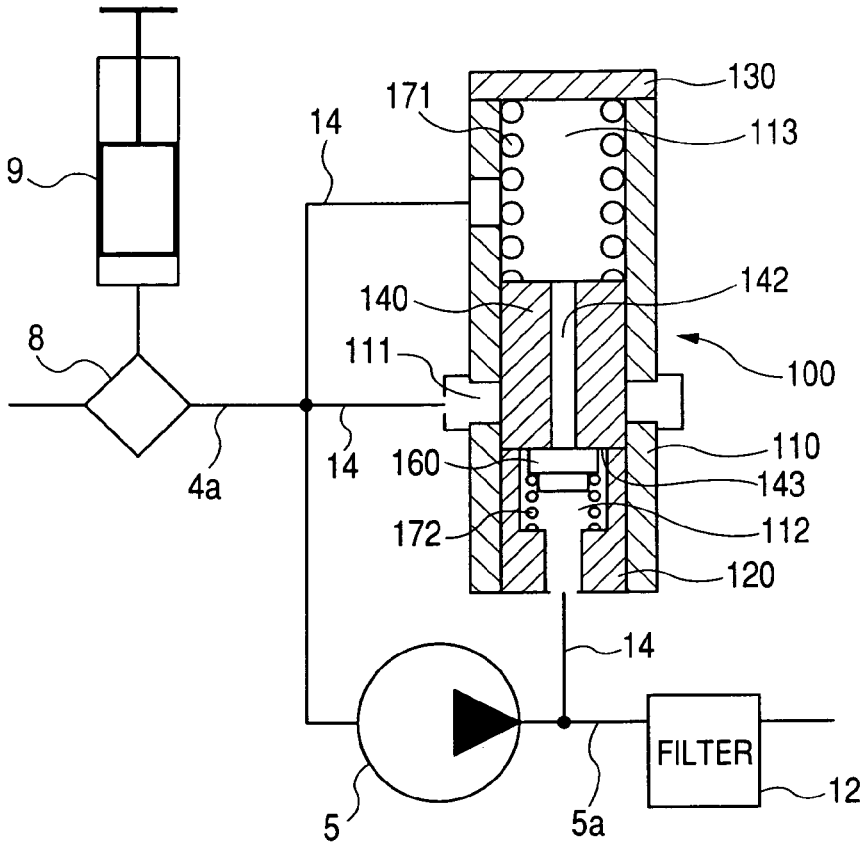
FIG. 5 is a longitudinal sectional view which illustrates an internal structure of a return valve according to the second embodiment of the invention which is placed in a closed position.

FIG. 5 illustrates the return valve 100 of a fuel supply system according to the second embodiment of the invention. The same reference numbers, as employed in the first embodiment, will refer to the same parts, and explanation thereof in detail will be omitted here.

The return valve 100 is designed to have a second valve element 160 which works to open the return path 14 when the fuel priming pressure reaches the second set pressure.

The first valve element 140 has formed therein a communicating path 142 which has opposed ends: one facing the first chamber 112, and the other facing the second chamber 113. Specifically, when the second valve element 160 is in an open position, the communicating path 142 communicates at the one end thereof with the return path 14 through first chamber 112. The communicating path 142 opens at the other end thereof into the second chamber 113 and communicates with the return path 14 at all the time.

A first spring 171 is disposed inside the second chamber 113 to urge the first valve element 140 toward the first chamber 112. In other words, the first spring 171 urges the first valve element 140 to a closed position which closes the return path 14.

The first valve element 140 has formed on the end thereof facing the first chamber 112 a flat valve seat 143 on which the second valve element 160 is seated. The second valve element 160 is made of a disc member and disposed inside the first chamber 112. A second spring 172 is disposed within the first chamber 112 to urge the second valve element 160 into constant abutment with the valve seat 143 to block the fluid communication between the communicating path 142 and the return path 14. In other words, the second spring 172 urges the second valve element 160 to keep it in the closed position to close the return path 14.

When the feed pump 5 is actuated, the fuel feeding pressure rises and acts on the end of the first valve element 140 facing the first chamber 112, so that the first valve element 140 is moved from the position, as illustrated in FIG. 5, toward the second chamber 113 (i.e., upward, as viewed in the drawing) against the pressure of the first spring 171. When the fuel feeding pressure reaches the first set pressure, it will cause the first valve element 140 is moved to a first open position which establishes the fluid communication between the first chamber 112 and the sleeve holes 111 to open the return path 14, thereby causing the part of the fuel lying downstream of the feed pump 5 to be returned back to upstream of the feed pump 5.

When the priming pump 9 is actuated, the fuel priming pressure is exerted on the second valve element 160 through the second chamber 113 and the communicating path 142. When the fuel priming pressure reaches the second set pressure, it will cause the second valve element 160 to be moved away from the valve seat 143 against the pressure of the second spring 172 to a second open position which establishes the fluid communication between the first chamber 112 and the second chamber 113 through the communicating path 142 to open the return path 14. This causes the fuel, as delivered by the priming pump 9, to flow from the inlet pipe 4*a*, to the return path 14, to the second chamber 113, to the communicating path 142, to the first chamber 112, to the return path 14, to the fuel path 5*a*, and to the fuel filter 12. In other words, the fuel, as fed from the priming pump 5, bypasses the feed pump 5 and reaches the fuel filter 12.

Figure 6:
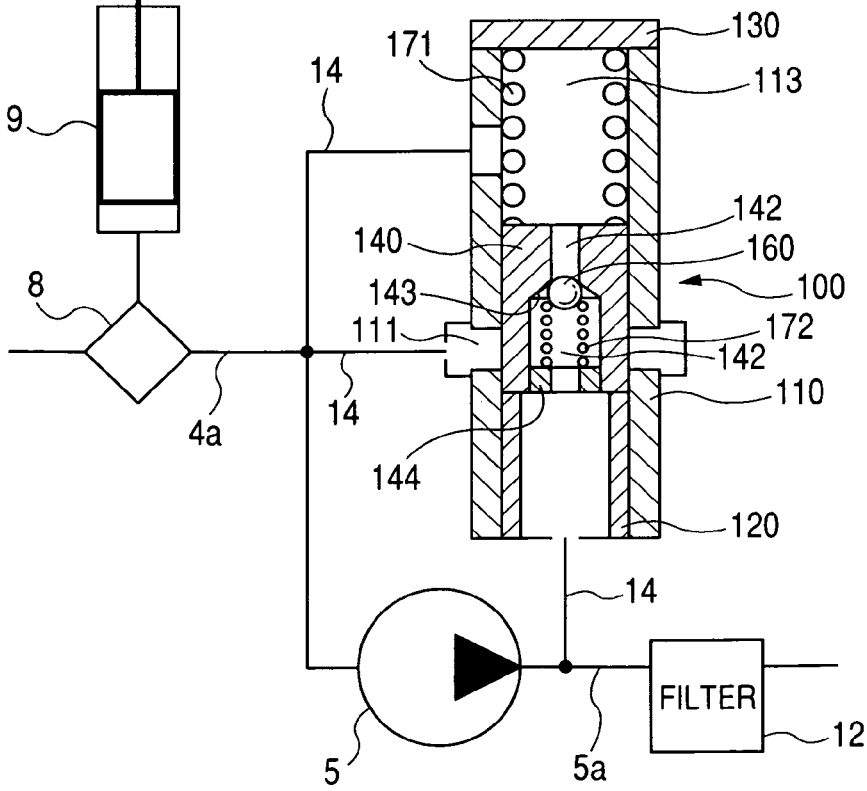
FIG. 6 is a longitudinal sectional view which illustrates an internal structure of a return valve according to the third embodiment of the invention which is placed in a closed position.

FIG. 6 illustrates the return valve 100 of a fuel supply system according to the third embodiment of the invention. The same reference numbers, as employed in the first and second embodiments, will refer to the same parts, and explanation thereof in detail will be omitted here.

The return valve 100 is designed to have the second valve element 160 and the second valve element 160 disposed inside the first valve element 140.

The first valve element 140, as clearly illustrated in FIG. 6, has a conical valve seat 143 formed on an inner periphery thereof exposed to the communicating path 142. The second valve element 160 is made of a ball and disposed inside the communicating path 142. The second spring 172 is also disposed inside the communicating hole 142. In other words, the second valve element 160 and the second spring 172 are installed within the first valve element 140. An annular spring retainer 144 is press-fit in the end of the communicating path 142 so as to urge the second valve element 160 into constant abutment with the valve seat 143 to close the communicating path 142. The spring retainer 144 constitutes the part of the first valve element 140. The second spring 172 is, therefore, held between the first valve element 140 and the second valve element 160.

When the feed pump 5 is actuated, the return valve 100 operates in the same manner as in the second embodiment to return the part of the fuel from downstream to upstream of the feed pump 5.

When the priming pump 9 is actuated, the fuel priming pressure is exerted on the second valve element 160 through the second chamber 113 and the communicating path 142. When the fuel priming pressure reaches the second set pressure, it will cause the second valve element 160 to be moved away from the valve seat 143 against the pressure of the second spring 172 to an open position which establishes the fluid communication between the first chamber 112 and the second chamber 113 through the communicating path 142 to open the return path 14. This causes the fuel, as delivered by the priming pump 9, to by pass the feed pump 5 and reaches the fuel filter 12.

The second spring 172 is, as described above, held by the first valve element 140 and the second valve element 160, so that the elastic pressure, as produced by the second spring 172, does not affect the operation of the first valve element 140. This stabilizes the pressure at which the first valve element 140 is to be moved to open the return path 14.

The second valve element 160 is made of a ball, while the valve seat 142 is formed to have a conical surface, thereby ensuring hermetical sealing of the communicating path 142.

The first valve element 140 is designed to have the second valve element 160 and the second spring 172, thus allowing the return valve 100 to be reduced in overall size thereof.

Figure 7:
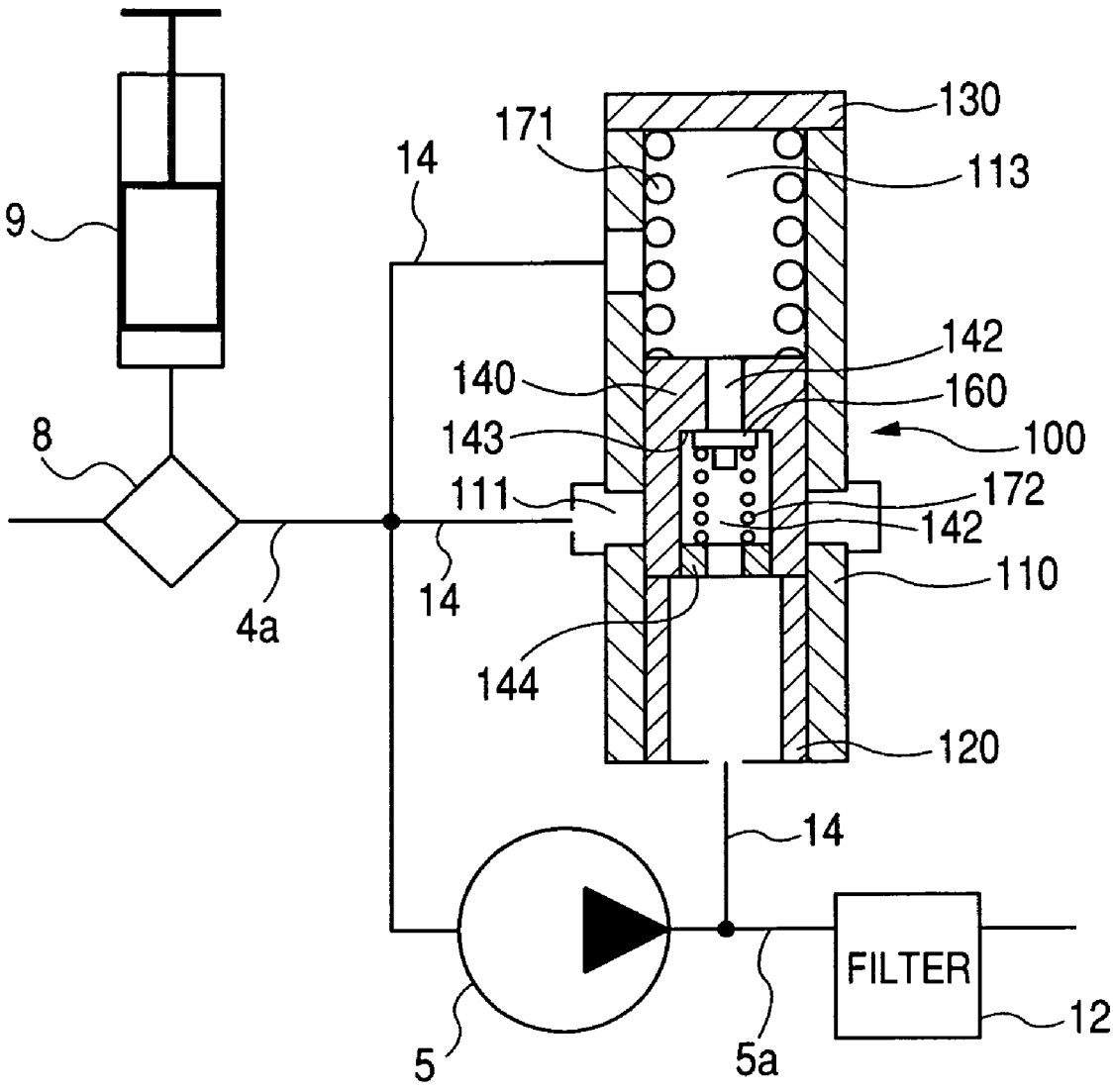
FIG. 7 is a longitudinal sectional view which shows a modification of the return valve of FIGS. 6.

The second valve element 160, as illustrated in FIG. 7, may alternatively be made of a disc. The communicating path 142 may alternatively be formed to have an annular flat shoulder which defines the valve seat 143 on which the second valve element 160 is seated hermetically. This structure results in east of machining the first and second valve elements 140 and 160.

Figure 8:
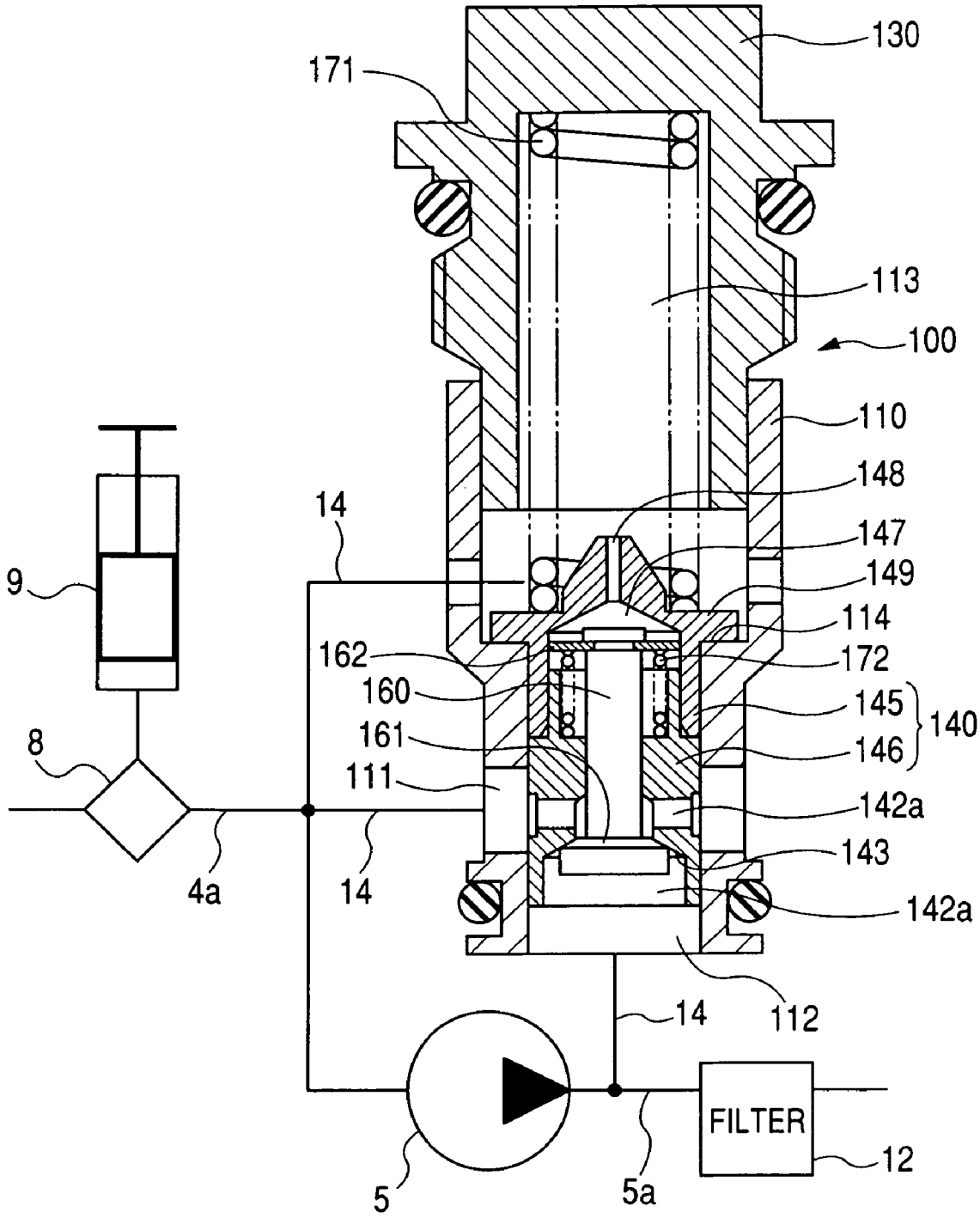
FIG. 8 is a longitudinal sectional view which illustrates an internal structure of a return valve according to the fourth embodiment of the invention.

FIG. 8 illustrates the return valve 100 of a fuel supply system according to the fourth embodiment of the invention. The same reference numbers, as employed in the first embodiment, will refer to the same parts, and explanation thereof in detail will be omitted here.

The return valve 100 is designed to have the second valve element 160 and the second spring 172 disposed inside the first valve element 140. The second valve element 160 and the second spring 172 are identical in operation with the ones in the second embodiment.

The first valve element 140 is made up of a cup-shaped body 145 and a hollow cylindrical body 146. The cup-shaped body 145 is formed by a hollow cylinder with a conical disc and will be referred to as a first valve body below. The hollow cylindrical body 146 is formed by a large-diameter and a small-diameter portion extending in alignment and will be referred to as a second valve body below. The second valve body 146 is press-fit in an open end of the first valve body 145. The first and second valve bodies 145 and 146 may alternatively be joined together in a screw fashion.

The first and second valve bodies 145 and 146 define therein a spring chamber 147 in which the second spring 172 is disposed. The spring chamber 147 communicates with a second chamber 113 through a communicating hole 149 formed in the first valve body 145. The first valve body 145 has a flange 149 which is the part of the conical disc, as described above. The flange 149 extends in a radius direction of the first valve body 145 (i.e., the return valve 100) and is placed in contacting abutment with an inner shoulder 114 formed on an inner peripheral wall of the sleeve 110.

The second valve body 146 has a T-shaped communicating path 142*a* which opens at one of three ends thereof into the first chamber 112 and at the other ends on the outer circumferential surface thereof. The second valve body 146 has formed therein a conical valve seat 143 which is exposed to the communicating path 142*a*.

The second valve element 160 is made of a cylindrical member or needle and disposed hermetically in the second valve body 146 of the first valve element 140 to be slidable in the lengthwise direction thereof. The second valve element 160 has a disc head which is exposed to the first chamber 112 and has a conical valve seat 161 formed thereon which is to be placed in contacting abutment with the valve seat 143 of the second valve body 146 of the first valve element 140 to close the communicating path 142*a*. A ring 162 is fit in an annular groove formed in the end of the second valve element 160 to retain the second spring 172 between itself and the second valve body 146 so as to urge the valve seat 161 of the second valve element 160 into constant abutment with the valve seat 143 of the second valve body 146.

In operation, when both the feed pump 5 and the priming pump 9 are not actuated, the first valve element 140 is, as illustrated in FIG. 8, urged by the first spring 171 into contacting abutment of the flange 149 with the inner shoulder 114 of the sleeve 110 to close the sleeve holes 111. The second valve element 160 is urged by the second spring 172 into contacting abutment of the valve seat 161 with the valve seat 143 of the second valve body 146 of the first valve element 140 to close the communicating path 142*a*.

When the feed pump 5 is actuated, the fuel feeding pressure rises and acts on the end of the first valve element 140 facing the first chamber 112 and the end of the second valve element 160 facing the first chamber 112, thereby lifting the first valve element 140 upward, as viewed in the drawing, (i.e., toward the second chamber 113) against the pressure of the first spring 171.

When the fuel feeding pressure reaches the first set pressure, it will cause the end of the first valve element 140 exposed to the first chamber 112 to be moved to the sleeve holes 111. Specifically, the first valve element 140 is moved to a position where the sleeve holes 111 communicate directly with the first chamber 112, thereby causing the part of the fuel lying downstream of the feed pump 5 to be returned back to upstream of the feed pump 5.

When the priming pump 9 is actuated, the fuel priming pressure is exerted on the second valve element 160 through the sleeve holes 111 and the communicating path 142*a* and also through the second chamber 113 and the communicating hole 148. When the fuel priming pressure reaches the second set pressure, it will cause the valve seat 161 of the second valve element 160 to be moved away from the valve seat 143 of the second valve body 146 of the first valve element 140 against the pressure of the second spring 172 to open the communicating path 142*a*, so that the fuel, as delivered by the priming pump 9, by-passes the feed pump 5 and flows into the fuel filter 12.

The second spring 172 is, as described above, held elastically between the first valve element 140 and the second valve element 160 (i.e., the ring 162), so that the elastic pressure, as produced by the second spring 172, does not affect the operation of the first valve element 140. This stabilizes the pressure at which the first valve element 140 is to be moved to open the return path 14.

The valve seats 161 and 160 of the second valve element 160 and the second valve body 146 are designed to have a conical surface, thus ensuring hermetical sealing of the communicating path 142*a*.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A fuel supply system for an accumulator fuel injection system designed to inject fuel, as stored in an accumulator, into an internal combustion engine through a fuel injector comprising:

a feed pump working to pump fuel out of a fuel tank through a first fuel path and feed the fuel to a second fuel path;

a high-pressure pump working to pressurize and supply the fuel, as fed from said feed pump through the second fuel path, to an accumulator;

a priming pump disposed between the fuel tank and said feed pump, said priming pump working to pump the fuel out of the fuel tank to feed the fuel through the first fuel path;

a fuel filter disposed in the second fuel path between said feed pump and the high-pressure pump to filter the fuel, as delivered from said feed pump to said high-pressure pump;

a return path extending from between said feed pump and said fuel filter in the second fuel path to between said priming pump and said feed pump in the first fuel path; and a return valve working to open and close said return path selectively, when a fuel feeding pressure that is a pressure of the fuel in the second fuel path between said feed pump and said fuel filter exceeds a first set pressure, said return valve being placed in a first open position to open said return path to return the fuel from downstream to upstream of said feed pump, when a fuel priming pressure that is a pressure of the fuel, as fed by said priming pump, exceeds a second set pressure, said return valve being placed in a second open position to open said return path to direct the fuel, as fed by the priming pump, to between said feed pump and said fuel filter.

2. A fuel supply system as set forth in claim 1, wherein said return valve includes a first valve element and a second valve element, the first valve element having a length with a first and a second end, the first end being to be subjected to the fuel feeding pressure, when the fuel feeding pressure reaches the first set pressure, the first valve element being moved in a lengthwise direction thereof to the first open position to open said return path, said first valve element having formed therein a communicating path communicating at ends thereof with said return path, when the fuel priming pressure exceeds the second set pressure, the second valve element opening the communicating path.

3. A fuel supply system as set forth in claim 2, wherein said return valve includes a first spring urging the first valve element into a closed position to close said return path and a second spring urging the second valve element into a closed position to close the communicating path.

4. A fuel supply system as set forth in claim 3, wherein the second spring is held elastically by the first and second valve elements.

5. A fuel supply system as set forth in claim 4, wherein the second valve element and the second spring are disposed in the communicating path, wherein the first valve element has a valve seat formed on an inner surface exposed to the communicating path, and wherein the second valve element is urged by the second spring into contacting abutment with the valve seat to close the communicating path.

6. A fuel supply system as set forth in claim 5, wherein the valve seat of the first valve element is of a conical shape, and wherein the second valve element is made of a ball.

7. A fuel supply system as set forth in claim 1, wherein said return valve includes a valve element having a length with a first and a second end, wherein the first end is to be subjected to the fuel feeding pressure, when the fuel feeding pressure reaches the first set pressure, the valve element being moved in a first direction oriented from the first to the second ends to the first open position to open said return path, and wherein the second end is to be subjected to the fuel priming pressure, when the fuel priming pressure exceeds the second set pressure, the valve element being moved in a second direction opposite the first direction to the second open position to open said return path.

8. A fuel supply system as set forth in claim 7, wherein the valve element has formed therein a communicating path with a first end communicating with said return path at all times and a second end establishing fluid communication with said return path selectively, and wherein when the valve element is moved to the second open position, it establishes the fluid communication of the second end with said return path.

9. A fuel supply system as set forth in claim 1, wherein said return valve includes a valve element and a hollow cylindrical sleeve, the sleeve having a sleeve hole formed in a middle portion in a lengthwise direction of the sleeve, the sleeve hole communicating with a portion of the first fuel path between said priming pump and said feed pump through said return path, wherein the valve element is disposed slidably within the sleeve to define a first chamber and a second chamber within the sleeve, the first chamber connecting with a portion of the second fuel path between said feed pump and said fuel filter through said return path, the second chamber connecting with a portion of the first fuel path between said priming pump and said feed pump through said return path, and wherein when the fuel feeding pressure is below the first set pressure, the valve element is placed in a closed position to close the sleeve hole to block fluid communication between the sleeve hole and the first chamber, when the fuel feeding pressure is higher than or equal to the first set pressure, the valve member is moved to the first open position which opens the sleeve hole to establish fluid communication between the sleeve hole and the first chamber to return the fuel from downstream to upstream of said feed pump.

* * * * *